US007330685B2

(12) United States Patent
Matayoshi

(10) Patent No.: US 7,330,685 B2
(45) Date of Patent: Feb. 12, 2008

(54) PHOTOCONDUCTIVE IMAGE FORMATION APPARATUS

(75) Inventor: Akira Matayoshi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 149 days.

(21) Appl. No.: 11/311,354

(22) Filed: Dec. 20, 2005

(65) Prior Publication Data

US 2006/0140684 A1 Jun. 29, 2006

(30) Foreign Application Priority Data

Dec. 28, 2004 (JP) ..... 2004-379001

(51) Int. Cl.
*G03G 15/01* (2006.01)
*G03G 15/16* (2006.01)

(52) U.S. Cl. ..... 399/299; 399/66; 399/167; 399/302

(58) Field of Classification Search ..... 399/299, 399/302, 66, 298, 303, 167; 347/115
See application file for complete search history.

(56) References Cited

U.S. PATENT DOCUMENTS

| | | | | |
|---|---|---|---|---|
| 5,970,286 | A * | 10/1999 | Numazu et al. | 399/167 |
| 6,445,899 | B2 * | 9/2002 | Sato | 399/299 X |
| 6,625,411 | B2 * | 9/2003 | Yoda et al. | 399/167 |
| 2005/0137745 | A1 * | 6/2005 | Takayama et al. | 700/230 |
| 2006/0120772 | A1 * | 6/2006 | Kitazawa et al. | 399/301 |

FOREIGN PATENT DOCUMENTS

JP 11-065222 3/1999

* cited by examiner

*Primary Examiner*—Sophia S. Chen
(74) *Attorney, Agent, or Firm*—Smith, Gambrell & Russell, LLP

(57) ABSTRACT

In a printer 10 provided with image formation units 60*a* to 60*d* arranged in tandem so as to be in contact with an intermediate transfer belt 52 that is stretched taut between a driving roller 53 and driven rollers 56*a* to 56*c*, the intermediate transfer belt 52 moves at speed Vb, the circumference of a photoconductive drum 61 of each of the image formation units 60*a* to 60*d* moves at speed Vd, and Vb and Vd are so set as to be Vb>Vd. When the printer 10 is activated, after the intermediate transfer belt 52 starts to rotate, the photoconductive drums 61 start to rotate one after the next starting with the one disposed most downstream along the rotation direction of the intermediate transfer belt 52.

3 Claims, 2 Drawing Sheets

PHOTOCONDUCTIVE IMAGE FORMATION APPARATUS

This application is based on Japanese Patent Application No. 2004-379001 filed on Dec. 28, 2004, the contents of which are hereby incorporated by reference.

BACKGROUND OF THE INVENTION

1. Field of the Invention

The present invention relates to an image formation apparatus in which image formation units are arranged in tandem.

2. Description of Related Art

A type of image formation apparatus for obtaining a color image is conventionally known in which image formation units are arranged in tandem that form magenta, cyan, yellow, and black toner images. In such an image formation apparatus, the different colored toner images formed by the different image formation units are transferred to a belt so as to be superimposed on each other, and are then collectively transferred from this belt to paper. On the other hand, when a belt is used to transport paper, different colored toner images are directly transferred from the image formation units to the paper transported by the belt so as to be superimposed on each other. In this image formation apparatus, when the belt runs at an uncertain speed, the images from the different image formation units cannot be superimposed accurately on each other on the belt. This makes color dislocation occur in the image thus formed on the paper.

Therefore, Japanese Patent Application Laid-Open No. H11-65222 proposes an image formation apparatus in which a belt transports paper and the speed of the circumference of a rotating photoconductive drum is so set as to be slower than the rotation speed of the belt. This makes the photoconductive drum that is in close contact with the belt rotate as if it were driven by the belt. As a result, torque of each photoconductive drum is applied to the belt, making it possible to reduce variations in speed of the belt and of each photoconductive drum.

When the image formation apparatus is activated, for example, color dislocation correction and belt speed correction are performed by the use of a toner patch. The color dislocation correction is performed as follows: different colored toner patches formed by the different image formation units and then transferred to the belt are detected by a sensor; then a time difference between times at which the different toner patches are detected is measured; and then control is performed so as to eliminate the time difference thus measured. On the other hand, the belt speed correction is performed according to, for example, the elapsed time between the start of formation of different colored toner patches in the different image formation units and the detection by the sensor of the toner patches thus formed, and to the set rotation speed of the belt. When there is slack in the belt, such a slackened state varies during use. This disturbs the corrected state, leading to occurrence of color dislocation. Therefore, it is necessary to always keep the rotating belt tight between the image formation units.

However, in the image formation apparatus proposed in Japanese Patent Application Laid-Open No. H11-65222, when slack occurs in the belt between the photoconductive drums at the time of activation, the belt tends to remain slack while the image formation apparatus is operating, because the photoconductive drum is in close contact with the belt. This requires time to take up slack in the belt.

SUMMARY OF THE INVENTION

An object of the present invention is to provide an image formation apparatus that can take up slack in a belt immediately after rotation thereof is started, and that can obtain a high-quality color image without color dislocation.

To achieve the above object, according to one aspect of the present invention, in an image formation apparatus provided with a belt that is stretched taut between a driving roller and at least one driven roller, and a plurality of image formation units that are arranged in tandem so as to be in contact with the belt, after the belt starts to rotate by the driving roller, photoconductive drums of the image formation units start to rotate one after the next starting with the photoconductive drum disposed most downstream along the rotation direction of the belt, and the rotation speed of the belt is faster than the speed of the circumference of the photoconductive drum.

Preferably, according to another aspect of the present invention, the image formation apparatus may be further provided with a transfer roller that is provided in a position facing the photoconductive drum across the belt, and, after rotation of all the photoconductive drums is started, application of a bias voltage to the transfer roller may be started and not stopped thereafter.

Preferably, according to still another aspect of the present invention, a photoconductor of the photoconductive drum may be amorphous silicon, and the belt may have a Young's modulus of smaller than or equal to 2000 MPa.

DETAILED DESCRIPTION OF PREFERRED EMBODIMENTS

Figure 1:
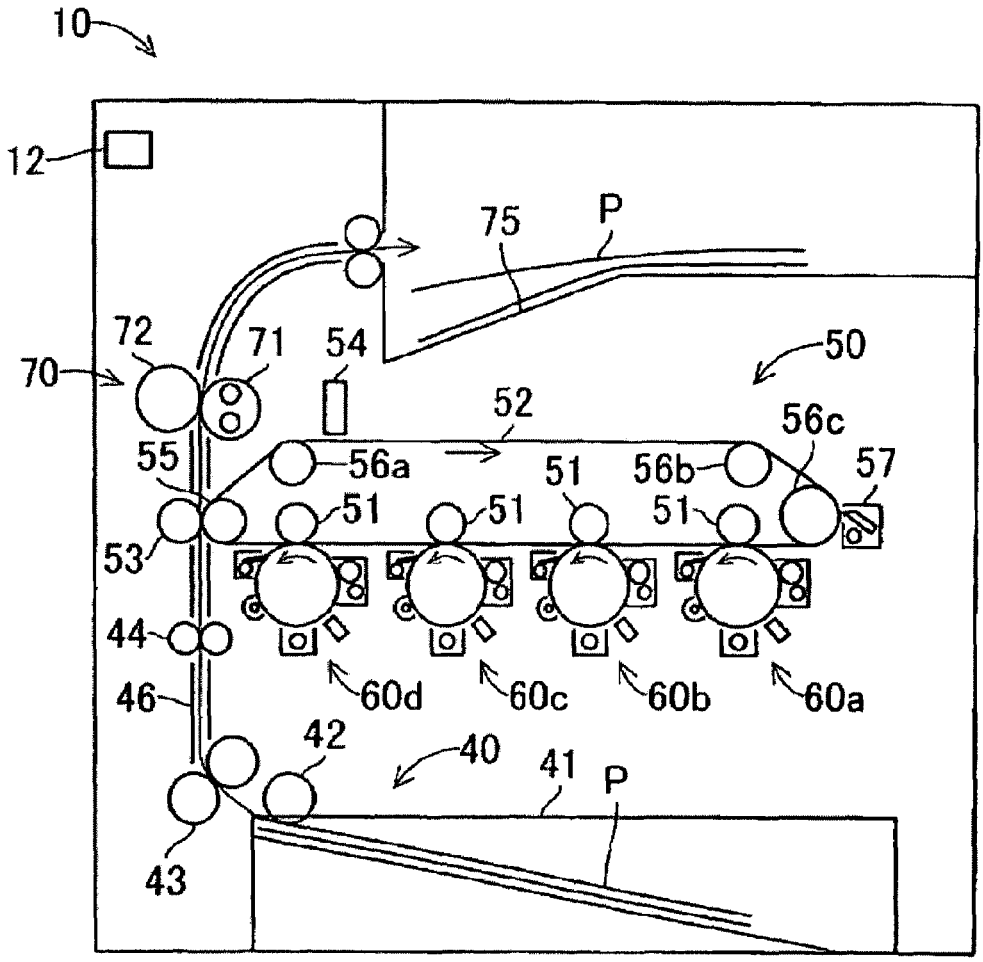
FIG. 1 is a schematic diagram of the configuration of the printer that is the image formation apparatus according to the present invention.
Figure 2:
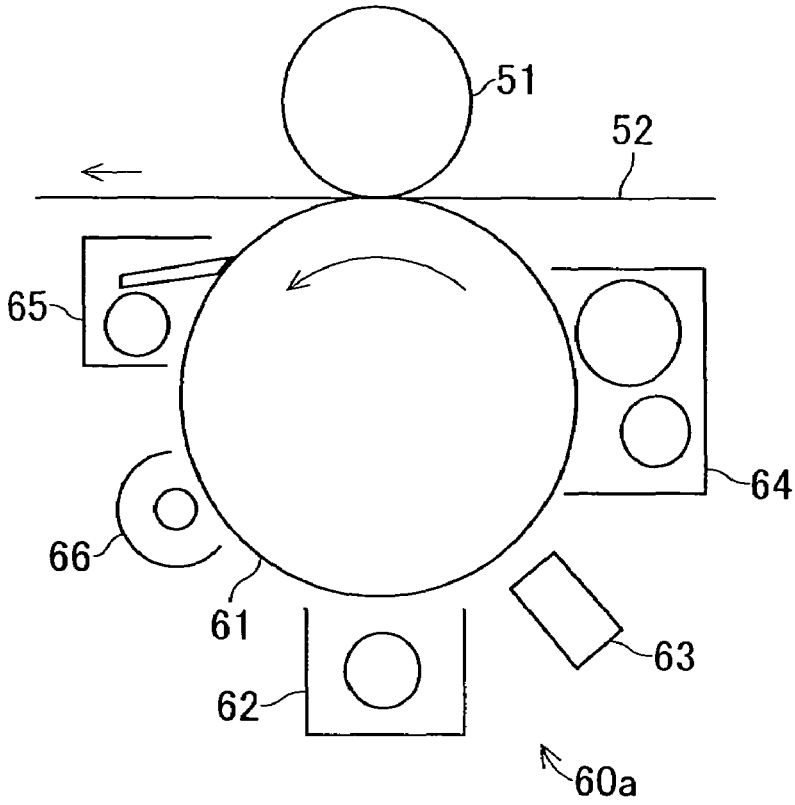
FIG. 2 is a partially enlarged view showing the neighborhood of the image formation unit.
Figure 3:
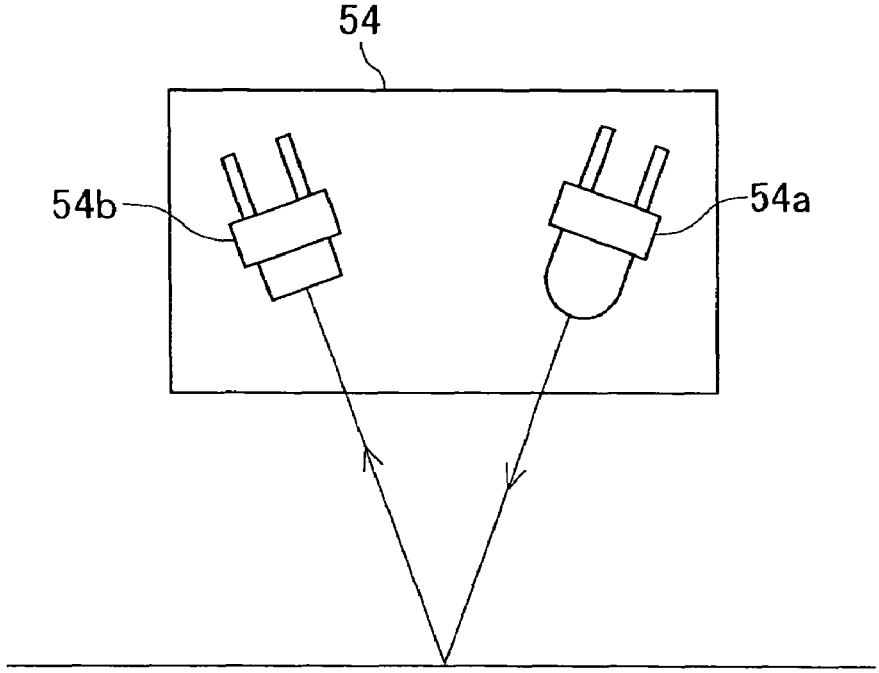
FIG. 3 is a schematic diagram of the configuration of the sensor.

A first embodiment of the present invention will be described with reference to FIGS. 1 to 3. FIG. 1 is a schematic diagram of the configuration of the printer that is the image formation apparatus according to the present invention, FIG. 2 is a partially enlarged view showing the neighborhood of the image formation unit, and FIG. 3 is a schematic diagram of the configuration of the sensor.

First, individual components provided in a printer 10 will be described. Inside the printer 10, there are provided a control portion 12, a paper feed portion 40, an image formation portion 50, and a fixing portion 70. The control portion 12 controls operations such as paper transportation operation and image formation operation.

The following description deals with the paper feed portion 40. The paper feed portion 40 is composed of a paper feed cassette 41, a paper feed roller 42, a pair of transportation rollers 43, and a pair of resist rollers 44. The paper feed cassette 41 accommodates paper P, and is located on the bottom of the main body of the printer 10. A sheet of paper P is sent therefrom to a paper transportation path 46 by the paper feed roller 42, and is then transported by the pair of transportation rollers 43, the pair of resist rollers 44, and the like.

Next, the image formation portion 50 will be described. The image formation portion 50 is composed of image formation units 60*a*, 60*b*, 60*c*, and 60*d*, one each for magenta, cyan, yellow, and black, a primary transfer roller 51, an intermediate transfer belt 52, a sensor 54, and a belt cleaner 57.

The intermediate transfer belt 52 is stretched taut between a driving roller 55 and driven rollers 56*a*, 56*b*, and 56*c*. The image formation units 60*a*, 60*b*, 60*c*, and 60*d* are in contact with the outer surface of a lower portion of the intermediate transfer belt 52. The driving roller 55 drives the intermediate transfer belt 52. In FIG. 1, the intermediate transfer belt 52 is rotated in a clockwise direction (in the direction indicated by the arrow). This embodiment deals with a case where there are provided three driven rollers 56*a*, 56*b*, and 56*c*. It should be understood, however, that the number of driven rollers is not limited to three. For example, there may be provided one or more driven rollers so long as the image formation units 60*a*, 60*b*, 60*c*, and 60*d* are in contact with the intermediate transfer belt 52.

The image formation units 60*a*, 60*b*, 60*c*, and 60*d* are arranged in tandem, and the order in which they are arranged can be changed. There are provided primary transfer rollers 51, one for each of the image formation units 60*a*, 60*b*, 60*c*, and 60*d*, located opposite thereto across the intermediate transfer belt 52.

As shown in the schematic diagram of FIG. 3 showing the configuration of the sensor 54, the sensor 54 is composed of an LED light-emitting portion 54*a* and a light-receiving portion 54*b* consisting of a phototransistor. The sensor 54 shines light on the intermediate transfer belt 52, then detects the intensity of light reflected therefrom, and then sends the detection signal obtained therefrom to the control portion 12. In this way, the sensor 54 detects the signal intensity of a toner patch formed on the intermediate transfer belt 52 for color dislocation correction, color tone correction, and the like.

The belt cleaner 57 removes from the intermediate transfer belt 52 the toner that has not been transferred to the paper P and the image density correction pattern that has been detected by the sensor 54, and has a blade that is in contact with the intermediate transfer belt 52.

The image formation units 60*a*, 60*b*, 60*c*, and 60*d* are identical in configuration, and, as shown in the partially enlarged view of FIG. 2 showing the neighborhood of the image formation unit 60*a*, there are disposed, from the bottom of the photoconductive drum 61 along the rotation direction (the direction indicated by the arrow) around the photoconductive drum 61 that rotates as the intermediate transfer belt 52 rotates, a charger 62, an LED print head 63, a developer 64, then over the part of the photoconductive drum 61 where it makes contact with the intermediate transfer belt 52, a cleaner 65, and a discharger 66.

Finally, the fixing portion 70 will be described. The fixing portion 70 is composed of a fixing roller 71 and a pressure roller 72 that are brought into contact with each other by pressurizing. The fixing portion 70 applies heat and pressure to the toner images transferred to the paper P so as to fix them to the paper P.

Next, the image formation operation will be described. When the user enters instructions for image formation to the main body of the printer 10 either directly or via an external computer, which is not shown, that is connected thereto through a network, the control portion 12 accepts the instructions, and then makes relevant portions operate. In FIGS. 1 and 2, the intermediate transfer belt 52 is made to rotate by the driving roller 55 in a clockwise direction (in the direction indicated by the arrow), and accordingly, the individual photoconductive drums 61 of the image formation units 60*a*, 60*b*, 60*c*, and 60*d* that are in contact with the intermediate transfer belt 52 rotate counterclockwise (in the directions indicated by the arrows). When the photoconductive drum 61 starts to rotate, the surface thereof is first uniformly charged by the charger 62. Then, electrical charges either on an image portion to be formed on the paper P or on a portion other than the image portion are removed by light shone from the LED print head 63 composed of a great number of LEDs according to an electrical signal representing an original image, which is sent from the external computer. As a result, an electrostatic latent image is formed on the surface of the photoconductive drum 61. Then, toner is fed from the developer 64 to develop the electrostatic latent image thus formed on the photoconductive drum 61 into a toner image.

When the photoconductive drum 61 further rotates and the toner image thus developed comes to a position facing the primary transfer roller 51 across the intermediate transfer belt 52, a bias voltage opposite in polarity to the toner is applied to the primary transfer roller 51 whereby the toner image is transferred to the intermediate transfer belt 52 from the photoconductive drum 61. The residual toner is removed by the cleaner 65, and the electrical charges remaining on the surface of the photoconductive drum 61 are removed by the discharger 66.

The toner images from the image formation units 60*a*, 60*b*, 60*c*, and 60*d* are transferred to the intermediate transfer belt 52 and superimposed on each other in the order mentioned. When the intermediate transfer belt 52 further rotates and the toner images thus superimposed on each other come to a position facing the secondary transfer roller 53, the paper P is transported between the intermediate transfer belt 52 and the secondary transfer roller 53 along the paper transportation path 46. At this time, a bias voltage opposite in polarity to the toner is applied to the secondary transfer roller 53 whereby the toner images superimposed on each other are transferred to the paper P from the intermediate transfer belt 52. The residual toner remaining on the intermediate transfer belt 52 is removed therefrom by the belt cleaner 57. The paper P on which the toner images are transferred is transported to the fixing portion 70, where the toner images are fixed thereto in such a manner as described above, and is then ejected into an output tray 75 located on the top of the printer 10.

In this embodiment, when the printer 10 is activated or resumes operating after a temporary halt, the intermediate transfer belt 52 starts to rotate by the driving roller 55 that rotates at a constant speed, and then the photoconductive drums 61 of the image formation units 60*d*, 60*c*, 60*b*, and 60*a* start to rotate one after the next at predetermined intervals starting with the one disposed most downstream along the rotation direction of the intermediate transfer belt 52. At this time, the surface of the intermediate transfer belt 52 moves at a constant speed Vb, so long as it is in contact only with the driven rollers 56*a* to 56*d*, and the photoconductive drum 61 moves at a constant speed Vd, so long as it is not in contact with anything. Vb and Vd are so set as to be Vb>Vd.

When the printer 10 is activated or resumes operating after a temporary halt, slack tends to occur in the intermediate transfer belt 52 between the image formation units 60*a* to 60*d*. However, with the configuration as described above, slack between the driving roller 55 and the image formation unit 60*d* is first taken up because of the difference in speed between the intermediate transfer belt 52 and the circumference of the photoconductive drum 61, and then slack between the image formation units 60*d* and 60*c* is taken up. Then, slack between the image formation units 60*c* and 60*b* and between the image formation units 60*b* and 60*a* is sequentially taken up. In this way, slack in the intermediate transfer belt 52 between the image formation units 60*a* to 60*d* can be taken up immediately after the intermediate transfer belt 52 starts to rotate.

When the printer 10 is activated, or after a predetermined number of images are formed, color dislocation correction and belt speed correction are performed by the use of a toner patch. The color dislocation correction is performed as follows: different colored toner patches formed by the image formation units 60*a* to 60*d* and then transferred to the intermediate transfer belt 52 are detected by the sensor 54; then a time difference between times at which the different colored toner patches are detected is measured; and then the time difference thus measured is eliminated by making the control portion 12 adjust the time at which the LED print head 63 shines light. On the other hand, the belt speed correction is performed by the control portion 12 according to the difference in time between a time at which each of the image formation units 60*a* to 60*d* makes the LED print head 63 shine light on the photoconductive drum 61 so as to form an electrostatic latent image of a toner patch and a time at which the sensor 54 detects the toner patch formed on the intermediate transfer belt 52, and according to the rotation speed of the intermediate transfer belt 52. Thus, if the above-described correction is performed when there is slack in the intermediate transfer belt 52, color dislocation occurs when, for example, the operation is stopped after correction and the slackened state varies accordingly. However, with the configuration as described above, slack in the intermediate transfer belt 52 is taken up immediately at both the time of activation of the printer 10 and the time of resumption of operation after a temporary halt. This makes it possible to perform color dislocation correction accurately. Moreover, the state in which color dislocation correction is achieved can be maintained, making it possible to obtain a high-quality image.

Furthermore, in an image formation apparatus that has image formation units arranged in tandem with respect to a belt and that transfers a toner image directly therefrom to paper transported by the belt, by making the belt and the photoconductive drum rotate in a manner similar to that described above, it is possible to take up slack in the belt immediately after activation of the apparatus. This makes it possible to perform color dislocation correction accurately by using a toner patch formed on the belt, and obtain a high-quality image.

A second embodiment of the present invention will be described. In the second embodiment, after slack in the intermediate transfer belt 52 between the image formation units 60*a* to 60*d* is taken up by the rotation of the photoconductive drums 61 of all the image formation units 60*a* to 60*d*, as described in the first embodiment, application of a bias voltage to each primary transfer roller 51 is started and sustained.

This contributes to the continued electrostatic absorption between the intermediate transfer belt 52 and each photoconductive drum 61, making it possible to maintain the tight state of the intermediate transfer belt 52 even if it becomes prone to bend in a particular shape through a long period of use. In addition, this keeps constant torque or rotational resistance of the intermediate transfer belt 52 resulting from the difference in speed between the surface of the intermediate transfer belt 52 and the circumference of the photoconductive drum 61, making it possible to stabilize the rotation speed of the intermediate transfer belt 52. Therefore, when color dislocation correction has been performed, the state in which color dislocation correction is achieved is maintained. This prevents color dislocation from easily occurring, making it possible to obtain a high-quality image.

Advisably, in the second embodiment, amorphous silicon may be used as a photoconductor on the circumference of the photoconductive drum 61, and the intermediate transfer belt 52 may have a Young's modulus of smaller than or equal to 2000 MPa.

When a foreign matter is attached to the surface of the intermediate transfer belt 52, it may scratch the photoconductor on the circumference of the photoconductive drum 61 depending on the difference in speed between the surface of the intermediate transfer belt 52 and the circumference of the photoconductive drum 61. On the other hand, when the intermediate transfer belt 52 is made of a soft material having a low Young's modulus, the intermediate transfer belt 52 so deforms to permit the foreign matter to get stuck therein. This makes it possible to prevent the photoconductor from being scratched by the foreign matter. Also in this case, with a bias voltage applied to the primary transfer roller 51, it is possible to maintain the tight state of the intermediate transfer belt 52 between the image formation units 60*a* to 60*d*.

Although amorphous silicon has a high degree of hardness and high wear resistance, it is easily scratched because it is a thin film, and the scratched amorphous silicon often affects an image to be formed. Thus, when amorphous silicon is used in the circumference of the photoconductive drum 61 as a photoconductor, by making the intermediate transfer belt 52 have a Young's modulus of smaller than or equal to 2000 MPa, it is possible to prevent the amorphous silicon photoconductor from being easily scratched, and, in addition, maintain the state in which no slack occurs in the intermediate transfer belt 52 between the image formation units 60*a* to 60*d* and color dislocation hardly occurs.

EXAMPLE

Suppose that amorphous silicon is used as a photoconductor, the intermediate transfer belt 52 is in contact with the photoconductive drum 61 with a contact area of 2.1 $cm^2$ and under a pressure of 3.5 $cm^2$/kg, the speed of the circumference of the photoconductive drum 61 is 50 mm/s, and the speed of the intermediate transfer belt 52 is 100 mm/s. Then, 1 gram of 400 grit sand was sprinkled across the outer surface of the intermediate transfer belt 52, and the printer 10 was operated for five minutes by using the intermediate transfer belts 52 with different Young's moduli ranging from 1000 to 2500 MPa, and then the photoconductor is checked for scratches. The results are shown in Table 1.

TABLE 1

| Young's Modulus (MPa) | Scratches in Amorphous Silicon |
|---|---|
| 1000 | Not Observed |
| 1500 | Not Observed |
| 1900 | Not Observed |
| 2000 | Not Observed |
| 2100 | Observed |
| 2500 | Observed |

As table 1 shows, when the intermediate transfer belt 52 has a Young's modulus of smaller than or equal to 2000 MPa, an amorphous silicon photoconductor is prevented from being scratched.

What is claimed is:

1. An image formation apparatus comprising:

a belt that is stretched taut between a driving roller and at least one driven roller; and a plurality of image formation units that are arranged in tandem so as to be in contact with the belt, wherein, after the belt starts to rotate by the driving roller, photoconductive drums of the image formation units start to rotate one after a next starting with the photoconductive drum disposed most downstream along a rotation direction of the belt, and wherein a rotation speed of the belt is faster than a speed of a circumference of the photoconductive drum.

2. The image formation apparatus of claim 1, further comprising:

a transfer roller that is provided in a position facing the photoconductive drum across the belt, and wherein, after rotation of all the photoconductive drums is started, application of a bias voltage to the transfer roller is started and not stopped thereafter.

3. The image formation apparatus of claim 2, wherein a photoconductor of the photoconductive drum is amorphous silicon, and wherein the belt has a Young's modulus of smaller than or equal to 2000 MPa.

* * * * *